US007804074B2

(12) United States Patent
Bernecker

(10) Patent No.: US 7,804,074 B2
(45) Date of Patent: Sep. 28, 2010

(54) LIGHTRAY TREATMENT DEVICE FOR HARDENING FINGERNAIL MODELING COMPOUNDS

(75) Inventor: Thomas Bernecker, Koblenz (DE)

(73) Assignee: European Nail Factory GmbH (DE)

( * ) Notice: Subject to any disclaimer, the term of this patent is extended or adjusted under 35 U.S.C. 154(b) by 161 days.

(21) Appl. No.: 12/078,813

(22) Filed: Apr. 7, 2008

(65) Prior Publication Data

US 2008/0289644 A1 Nov. 27, 2008

(30) Foreign Application Priority Data

May 26, 2007 (DE) ..... 20 2007 007 527 U

(51) Int. Cl.
*B21K 5/00* (2006.01)
*A61N 5/06* (2006.01)
*F26B 3/28* (2006.01)

(52) U.S. Cl. ..... 250/455.11; 250/492.1; 250/493.1; 250/504 R; 132/73; 132/73.5; 424/400; 424/401; 34/245; 34/275

(58) Field of Classification Search ..... 250/453.11, 250/454.11, 455.11, 458.1, 461.1, 493.1, 250/494.1, 503.1, 504 R, 504 H, 491.1, 492.1; 132/73, 73.5; 424/400, 401; 34/245, 275
See application file for complete search history.

(56) References Cited

U.S. PATENT DOCUMENTS

| | | | | |
|---|---|---|---|---|
| 4,979,523 | A * | 12/1990 | Grimm | 132/73.5 |
| 5,249,367 | A * | 10/1993 | Nafziger et al. | 34/275 |
| 6,518,583 | B1 * | 2/2003 | Hennig | 250/504 R |
| 6,762,425 | B1 * | 7/2004 | Strait | 250/504 R |
| 7,712,473 | B1 * | 5/2010 | Robinson et al. | 132/73 |
| 2004/0065336 | A1 * | 4/2004 | Fung | 132/73.5 |
| 2004/0250443 | A1 * | 12/2004 | Delaney et al. | 34/275 |

* cited by examiner

*Primary Examiner*—Jack I Berman
*Assistant Examiner*—Nicole Ippolito Rausch
(74) *Attorney, Agent, or Firm*—Timothy J. Klima; Shuttleworth & Ingersoll, PLC

(57) ABSTRACT

A lightray treatment device (1) for hardening fingernail modeling compounds has a lightray treatment chamber (3) enclosed in a housing (2) and can be comfortably reached by both the left and right hands of a user of the device (1). The housing (2) has two oppositely located wall openings (6, 7) and a hand support surface (8, 9) with a thumb support (12, 13) assigned to each wall opening (6, 7) in the lightray treatment chamber (3). At least two light sources (10, 11) are arranged in the lightray treatment chamber (3), of which the first light source (10) is used for treating the thumb with light and is arranged in front of the thumb supports (12, 13) of the hand support surfaces (8, 9), and the second light source (11) is arranged in the ceiling of the lightray treatment chamber (3).

15 Claims, 4 Drawing Sheets

LIGHTRAY TREATMENT DEVICE FOR HARDENING FINGERNAIL MODELING COMPOUNDS

FIELD OF THE INVENTION

The invention relates to a lightray treatment device for hardening fingernail modeling compounds.

BACKGROUND OF THE INVENTION

Such lightray treatment devices are known, for example, from the publications DE 86 09 293 U1, DE 200 04 094 U1 or DE 20 2006 005 790 U1. Essentially, they consist of a housing having a wall opening for introducing the hand with the fingernail modeling compounds to be hardened (also called nail templates) into an lightray treatment chamber arranged inside the housing.

In connection with the known lightray treatment devices it is only possible to introduce respectively one hand into the lightray treatment chamber and to treat it. Since the end positions of the fingernails of the left and the right hand differ from each other, it is required for optimal lightray treatment of the modeling compounds to provide respectively one UV light source for the thumb and at least one UV light source for the remaining fingers of each hand. Therefore, if a subsequent lightray treatment of both hands one after the other is to be provided by means of the known lightray treatment devices, it is necessary to arrange at least a total of three, but as a rule four light sources in the lightray treatment chamber. This results in an essentially cupola-shaped lightray treatment chamber.

Therefore the above-mentioned lightray treatment devices require extensive space in regard to their construction and are also relatively cost-intensive regarding their fittings. Moreover, the use of the known lightray treatment devices for both hands requires that, when changing the hands, either the position of the respective lightray treatment device or the posture of the body of the respective user must be changed.

Although some cosmetic establishments provide a separate lightray treatment device for each hand of the respective user, which is appropriately positioned, this is connected with a large cost expenditure, as well as with a correspondingly large space requirement.

OBJECT AND SUMMARY OF THE INVENTION

The object of the invention is based on disclosing a simply constructed and easily operable lightray treatment device, whose lightray treatment chamber can be comfortably accessed by the left, as well as the right hand, without a change in the position of the lightray treatment device or a change in the posture of the body of the user being required.

In accordance with the invention, this object is attained by means of the characteristics of claim 1. Further particularly advantageous designs of the invention are disclosed in the dependent claims.

The invention is essentially based on the idea of providing the housing of the lightray treatment device with a second wall opening, which is placed opposite the first wall opening and is also connected with the lightray treatment chamber in such a way that it is possible to introduce both hands of a user into the lightray treatment chamber from the outside through wall openings and to place them on appropriate hand support surfaces, including thumb support surfaces.

With the lightray treatment device in accordance with the invention a total of only two light sources, which are advantageously arranged perpendicularly in respect to each other, are required for the simultaneous or chronologically subsequent treatment of the fingernails of both hands. In this case the first light source is arranged (laterally) in front of the thumb supports of the hand support surfaces, and the second light source for treating the remaining fingers at the ceiling of the lightray treatment chamber.

Viewed from above, the two light sources can be arranged in a T-shape or in the shape of a cross. The light sources should be selected in principle with regard to the substance of which the nail modeling compound consists, or which is to be hardened.

In case of modeling compounds which can be hardened by UV light, the light sources can be UV gas discharge lamps, as well as UV LED lightray treatment arrangements.

It has been shown to be advantageous if each of the hand support surfaces of the lightray treatment device in accordance with the invention has a rib-shaped raised part, which can be located by touch by the thumb and adjoining index finger and can thereafter be clasped, so that the fingernail modeling compounds are treated in an exactly defined position of the hand.

Further details and advantages of the invention ensue from the following exemplary embodiments explained by means of the drawings.

DETAILED DESCRIPTION OF THE PREFERRED EMBODIMENTS

Figure 1:
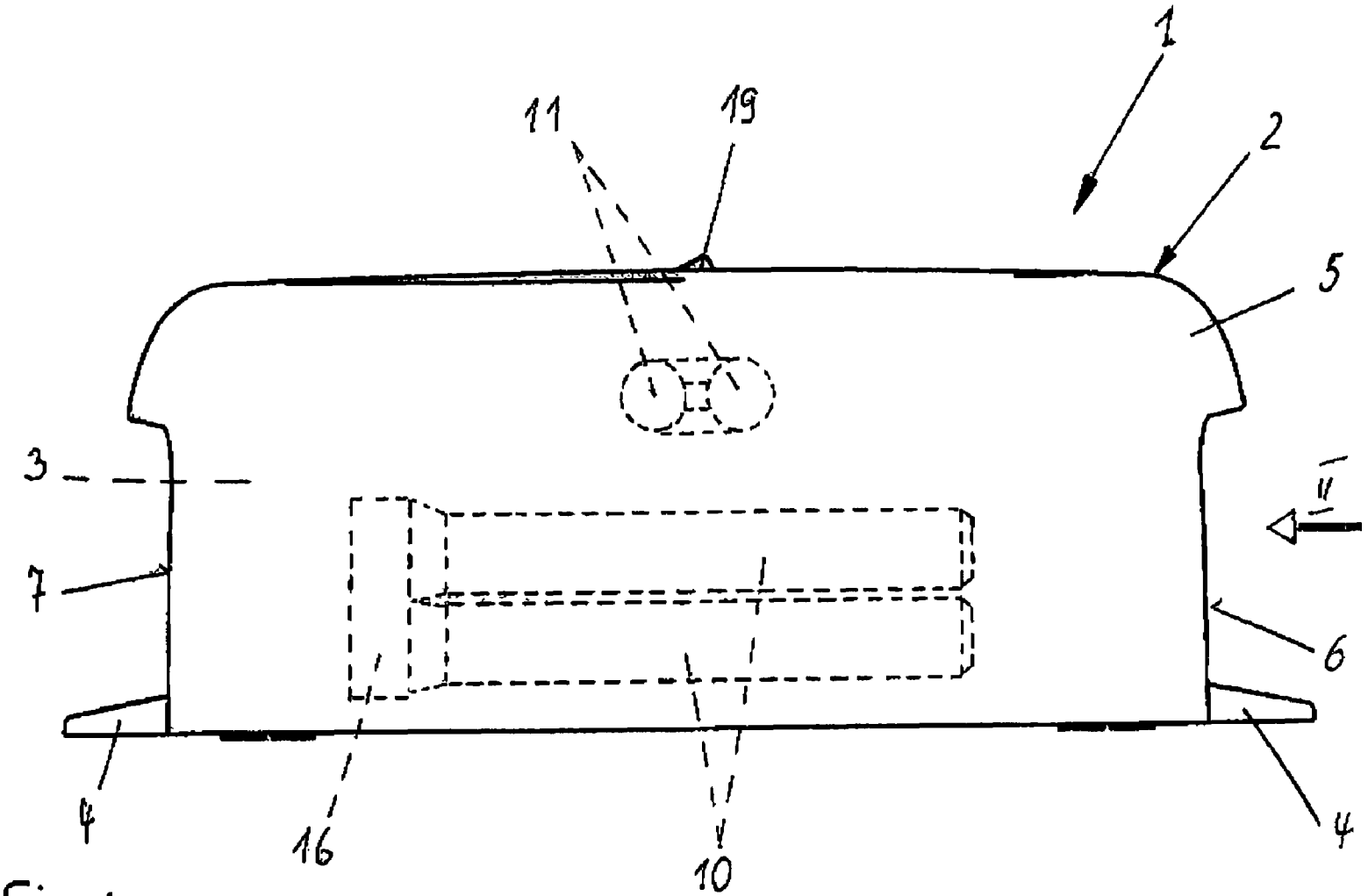
FIG. 1 is a lateral view of a lightray treatment device in accordance with the invention with the housing closed, wherein the arrangement of the light sources inside the housing is indicated by dashed lines.
Figure 2:
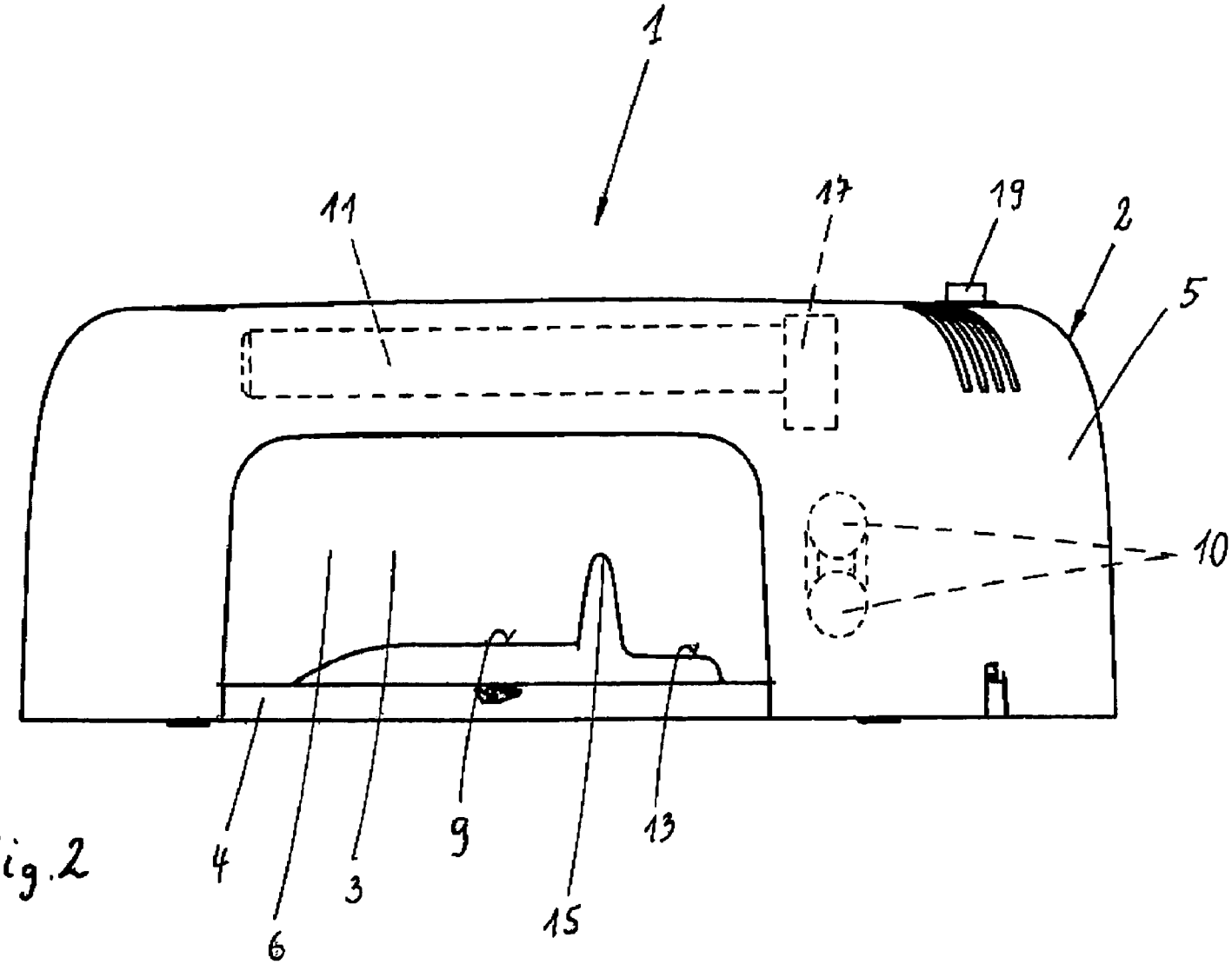
FIG. 2 is a plan view of the lightray treatment device in accordance with the invention from the side indicated by number II in FIG. 1, wherein the arrangement of the light sources inside the housing is again indicated by dashed lines.

A lightray treatment device in accordance with the invention is identified by 1 in FIGS. 1 and 2 and is comprised of a housing 2, which surrounds a lightray treatment chamber 3.

The housing 2 consists substantially of a bottom element 4 and a housing cover 5. It has two oppositely located wall openings 6, 7, which are connected with the lightray treatment chamber 3 in such a way that, when the lightray treatment device 1 is employed in accordance with its purpose, both hands of a user can be introduced from the outside through the wall openings 6, 7 into the lightray treatment chamber 3 and can be placed on appropriate hand support surfaces 8, 9.

Two UV gas discharge lamps 10, 11, which are substantially arranged in the lightray treatment chamber 3 in a T-shape in respect to each other and are designed in a double-bar shape, are provided for treating the fingernail modeling compounds. Here, the first gas discharge lamp 10 is arranged laterally in front of the thumb supports 12, 13 of the hand support surfaces 8, 9, and the second gas discharge lamp 11 for treating the remaining fingers at the ceiling of the lightray treatment chamber 3.

The two hand support surfaces 8, 9 have rib-shaped raised parts 14, 15, which can be easily located by touch by the thumb and adjoining index finger of the respective user in the course of the introduction of the hands into the lightray treatment chamber 3 and can be clasped. In this way the hands, and therefore also the fingernails of the respective user can take up an exactly defined position inside the lightray treatment chamber 3.

Figure 3:
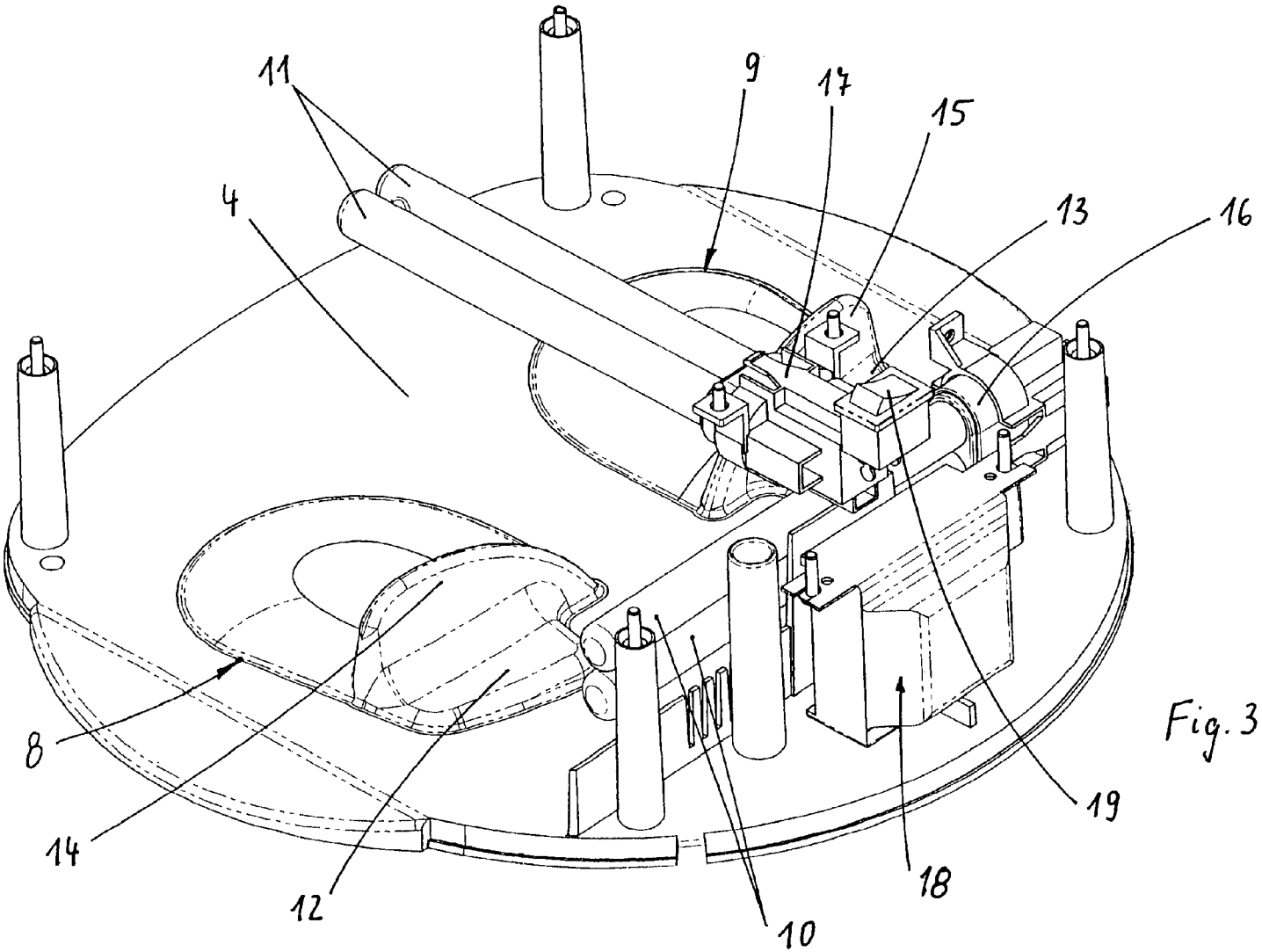
FIG. 3 is a perspective plan view of the lightray treatment device represented in FIGS. 1 and 2, but without showing the housing cover.

The holders of the gas discharge lamps 10, 11 are identified in FIG. 3 by the reference numerals 16, 17 and are connected with an electrical circuit arrangement 18, which can be actuated in turn by means of a switch 19.

Figure 4:
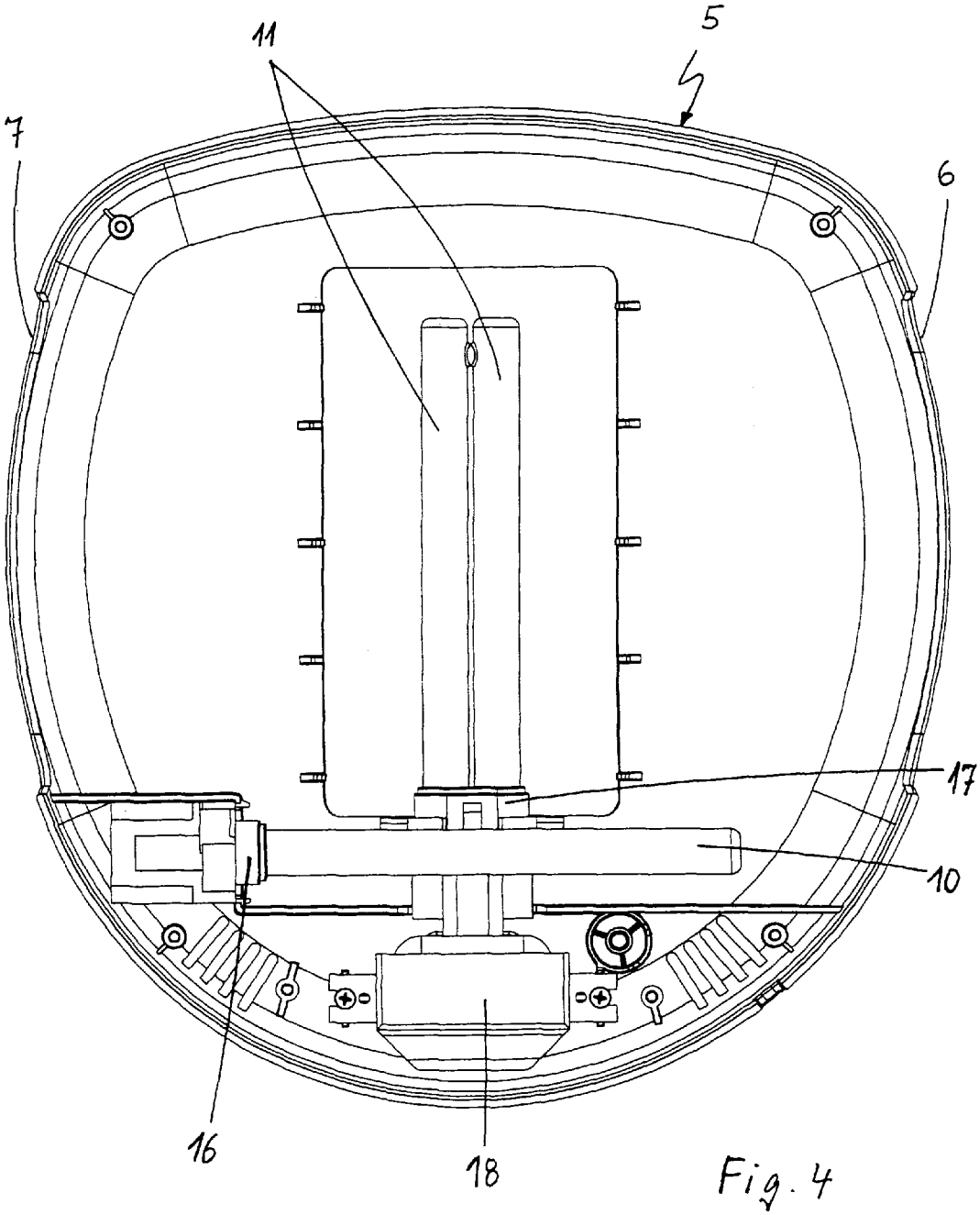
FIG. 4 is a view from below of the complete housing cover.

As FIG. 4 shows, the light sources 10, 11, their holders 16, 17, including the circuit arrangement 18, as well as the switch 19 are assigned to the housing cover 5, i.e. fixedly mounted thereon. In contrast thereto, the bottom element 4 represents only a closing element for the housing. When it is unscrewed and removed, the entire technical installation is accessible to one skilled in the art, so that he can simply and rapidly perform a lamp change, for example.

The invention is of course not limited to the above described exemplary embodiment. Thus, the light sources 10, 11 do not necessarily need to be UV gas discharge lamps. Instead, UV LED lightray treatment arrangements can also be employed for the same nail modeling compound, in which case several LEDs can be combined into a line array.

In every case the invention leads to a simplified construction of a lightray treatment device. Thus, two directed light sources are sufficient instead of the three used up to now. Furthermore, a lightray treatment device in accordance with the invention can be more universally employed and is easier to use. What two conventional devices had to provide up to now is now provided by a single one. As a result it is possible by means of this to show savings in manufacturing and operating costs. With conventional devices, at least one light source was operated for nothing. This is different in case of a lightray treatment device in accordance with the invention. Within the meaning of an even more extensive energy savings, both hands can also be simultaneously treated with light. Last but not least there is the possibility of saving time.

LIST OF REFERENCE NUMERALS

1 Lightray treatment device
2 Housing
3 Lightray treatment chamber
4 Bottom element
5 Housing cover
6, 7 Wall openings
8, 9 Hand support surfaces
10, 11 (UV) gas discharge lamps, light sources
12, 13 Thumb supports
14, 15 Rib-shaped raised parts
16, 17 Holders
18 Circuit arrangement
19 Switch

What is claimed is:

1. A lightray treatment device for hardening fingernail modeling compounds, comprising:

a) a housing which surrounds a lightray treatment chamber, b) first and second openings positioned on opposite sides of the housing such that both hands of a user of the lightray treatment device can be simultaneously introduced into the lightray treatment chamber from opposite sides of an exterior of the housing through a respective one of the first and second wall openings, c) first and second hand support surfaces positioned in the lightray treatment chamber adjacent the first and second wall openings, respectively, on which a respective hand can be placed for assuming a treatment position, each hand support surface including a thumb support on which a respective thumb can be placed, d) only two light sources arranged in the lightray treatment chamber, the first light source positioned in front of the thumb supports of the hand support surfaces to simultaneously treat both thumbs with light, the second light source positioned above the first light source at a ceiling of the lightray treatment chamber and centrally between both hands for simultaneously treating remaining fingers of both hands with light.

2. The lightray treatment device in accordance with claim 1, wherein the light sources are substantially arranged perpendicularly with respect to each other.

3. The lightray treatment device in accordance with claim 2, wherein, viewed from above, the two light sources are arranged in at least one of a T- and a cross-shape with respect to each other.

4. The lightray treatment device in accordance with claim 2, wherein the light sources are UV gas discharge lamps.

5. The lightray treatment device in accordance with claim 2, wherein the light sources are UV LED lightray treatment devices.

6. The lightray treatment device in accordance with claim 2, wherein each of the hand support surfaces has a rib-shaped raised part, which can be located by touch by the thumb and adjoining index finger of a user of the lightray treatment device and can thereafter be clasped.

7. The lightray treatment device in accordance with claim 3, wherein the light sources are UV gas discharge lamps.

8. The lightray treatment device in accordance with claim 7, wherein each of the hand support surfaces has a rib-shaped raised part, which can be located by touch by the thumb and adjoining index finger of a user of the lightray treatment device and can thereafter be clasped.

9. The lightray treatment device in accordance with claim 3, wherein the light sources are UV LED lightray treatment devices.

10. The lightray treatment device in accordance with claim 9, wherein each of the hand support surfaces has a rib-shaped raised part, which can be located by touch by the thumb and adjoining index finger of a user of the lightray treatment device and can thereafter be clasped.

11. The lightray treatment device in accordance with claim 3, wherein each of the hand support surfaces has a rib-shaped raised part, which can be located by touch by the thumb and adjoining index finger of a user of the lightray treatment device and can thereafter be clasped.

12. The lightray treatment device in accordance with claim 1, wherein, viewed from above, the two light sources are arranged in at least one of a T- and a cross-shape with respect to each other.

13. The lightray treatment device in accordance with claim 1, wherein the light sources are UV gas discharge lamps.

14. The lightray treatment device in accordance with claim 1, wherein the light sources are UV LED lightray treatment devices.

15. The lightray treatment device in accordance with claim 1, wherein each of the hand support surfaces has a rib-shaped raised part, which can be located by touch by the thumb and adjoining index finger of a user of the lightray treatment device and can thereafter be clasped.

* * * * *